US005258113A

United States Patent [19]

Edgerton et al.

[11] Patent Number: 5,258,113

[45] Date of Patent: Nov. 2, 1993

[54] PROCESS FOR REDUCING FCC TRANSFER LINE COKING

[75] Inventors: Mary E. Edgerton, Trenton; Ajit V. Sapre, W. Berlin, both of N.J.

[73] Assignee: Mobil Oil Corporation, Fairfax, Va.

[21] Appl. No.: 650,160

[22] Filed: Feb. 4, 1991

[51] Int. Cl.[5] ..... C10G 9/16

[52] U.S. Cl. ..... 208/48 AA; 208/48 R; 208/348; 208/106; 208/47; 208/153; 208/163

[58] Field of Search ..... 208/48 AA

[56] References Cited

U.S. PATENT DOCUMENTS

| | | | |
|---|---|---|---|
| 3,328,284 | 6/1967 | Godar | 208/48 |
| 3,531,394 | 9/1970 | Koszman | 208/48 |
| 3,647,677 | 3/1972 | Wolff et al. | 208/48 |
| 4,024,048 | 5/1977 | Shell et al. | 208/48 AA |
| 4,105,540 | 8/1978 | Weinland | 208/48 |
| 4,642,175 | 2/1987 | Rudnick | 208/48 AA |
| 4,680,421 | 7/1987 | Forester et al. | 208/113 |
| 4,724,064 | 2/1988 | Reid | 208/48 |
| 4,747,931 | 5/1988 | Forrester | 208/48 AA |
| 4,756,819 | 7/1988 | Bousquet et al. | 208/113 |
| 4,756,820 | 7/1988 | Reid et al. | 208/48 |
| 4,776,948 | 10/1988 | Skraba | 208/100 |
| 4,784,752 | 5/1988 | Ramamoorthy et al. | 208/48 AA |
| 4,804,456 | 2/1989 | Forester | 208/48 AA |
| 4,828,674 | 5/1989 | Forester | 208/48 AA |
| 4,889,614 | 12/1989 | Forester | 208/48 |
| 5,000,836 | 3/1991 | Forester et al. | 208/113 |
| 5,158,667 | 10/1992 | Barlow et al. | 208/48 AA |

*Primary Examiner*—Helane Myers

*Attorney, Agent, or Firm*—Alexander J. McKillop; Malcolm D. Keen; Richard D. Stone

[57] ABSTRACT

Coke formation/deposition within and downstream of catalytic cracking reactors is suppressed by adding a coke suppressing additive to the cracking reactor and/or cracked product vapor. Free radical inhibitors, such as oxygenates, are preferred. The additive addition rate is preferably controlled based on temperature of regenerated catalyst, or a direct or indirect measurement of coke accumulation on the transfer line between the cracking reactor and the main fractionator.

15 Claims, 5 Drawing Sheets

PROCESS FOR REDUCING FCC TRANSFER LINE COKING

BACKGROUND OF THE INVENTION

1. FIELD OF THE INVENTION

The field of the invention is reduction of coking in high temperature transfer lines, such as the transfer line from an FCC reactor to the FCC main column.

2. DESCRIPTION OF RELATED ART

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite-containing catalysts having high activity and selectivity are now used in most FCC units. These catalysts work best when coke on the catalyst after regeneration is less than 0.1 wt %, and preferably less than 0.05 wt %.

To regenerate FCC catalysts to these low residual carbon levels, and to burn CO completely to CO2 within the regenerator (to conserve heat and minimize air pollution) many FCC operators add a CO combustion promoter metal to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

As the process and catalyst improved, refiners attempted to use the process to upgrade a wider range of feedstocks, in particular, feedstocks that were heavier, and also contained more metals and sulfur than had previously been permitted in the feed to a fluid catalytic cracking unit.

Refiners have tended to push their FCC units as much as possible, both with a view to maximizing yields of gasoline and light olefins and to process ever heavier feedstocks. Higher riser top temperatures increase yields of gasoline and light olefins, and also may improve somewhat the ability of the FCC unit to crack heavier feeds. Unfortunately, the heavier feeds, and/or the higher riser top temperatures, have produced reactor effluents having a temperature, and sometimes containing reactive materials which tend to form coke.

Coke formation in catalytic cracking units has been a problem since the beginning of cat cracking. Coke readily forms in any dead space. Dome coke, sometimes called the "fifth" kind of coke formed in FCC units is a severe problem in every FCC having a dome shaped vessel containing the cyclones and/or other equipment associated with the reactor outlet. The problem of dome coke was solved by adding small amounts of steam, typically 500 to 1000 #/hr, to purge the dome. Most FCC units now have this, but the practice of adding dome steam is so common that the reason for adding dome steam is rarely discussed.

Coking beneath the bubble cap trays in the fractionator associated with moving bed cracking units has also been a problem for almost 50 years. The high temperature vapor from the moving bed cracking unit would, if allowed to remain stagnant for a long time in the TCC main column, form coke inside the column. This problem was solved by adding copious amounts of quench liquid to the TCC column inlet, so that a two phase, quenched mixture is added to the main column.

With ever heavier feeds, and ever higher riser top temperatures, the transfer lines between the dome and main column are now starting to coke in some units. This is a severe problem, for several reasons.

As coke levels on transfer lines build, the coking tends to get worse, because the porous coke deposits provide an ideal place for fresh coke deposits to form. The reduced diameter of the transfer line increases pressure drop through the system, raising reactor pressures somewhat, which tends to adversely affect yields The coke deposition also increases the weight of the transfer line, which is usually designed to be full of hot vapor, rather than clogged with coke. In some units the problem of coking in transfer lines downstream of the FCC reactor has become so severe that the unit had to be shut down to permit replacement of the transfer line.

We studied a commercial FCC unit, which had a problem with coke deposition in the transfer line to the main column, and realized that the problem was caused by thermal formation of free radicals, which polymerized and laid down coke in the transfer line.

The conventional approaches used to solve coking problems in catalytic cracking units were not applicable. Although 500 or 1000 #/hr of dome steam does a good job of purging stagnant areas in the dome, it did nothing, so far as we could tell, toward reducing coking in transfer lines. The dome steam is minuscule compared to the amount and volume of hot product flowing through the transfer line. Although quenching the transfer line might seem to be applicable, we were concerned at the costs of this, and feared that it might make the problem worse, i.e., adding a liquid could deposit liquid on a hot surface and cause coke to form on the hot surface.

We discovered a way to reduce coking at essentially no capital expense, and with very little operating expense. Our solution required only that an effective amount of a coke suppressing additive be added, or present, in the transfer line from a cat cracker.

BRIEF SUMMARY OF THE INVENTION

Accordingly, the present invention provides a fluidized catalytic cracking process wherein a heavy hydrocarbon feed comprising hydrocarbons having a boiling point above about 650°F. is catalytically cracked to produce spent catalyst and cracked products comprising coke precursors which form coke deposits on solid surfaces by catalytically cracking said feed in a catalytic cracking zone operating at catalytic cracking conditions by contacting in a catalytic cracking reaction zone operating at catalytic cracking conditions said feed with a source of hot regenerated catalytic cracking catalyst having cracking activity withdrawn from a catalyst regenerator, and cracking said feed in said reactor to produce catalytically cracked products and spent catalyst which are discharged and separated from spent catalyst to produce a cracked product vapor phase including coke precursors which is removed from said disengaging zone via a transfer line as a vapor product and a spent catalyst phase which is discharged from said disengaging zone into a catalyst stripper, stripped, regenerated by contact with a regeneration gas and recycled to said cracking reactor to crack said heavy feed, characterized by adding to said feed or to said cracking reactor an amount of a coke suppressing additive sufficient to suppress formation of coke or deposition of coke on solid surfaces, said additive added in a form and in an amount such that there is no adverse affect on the cracking activity of the cracking catalyst.

In another embodiment, the present invention provides a fluidized catalytic cracking process wherein a heavy hydrocarbon feed comprising hydrocarbons having a boiling point above about 650° F. is catalytically cracked to produce spent catalyst and cracked products comprising coke precursors which form coke deposits on solid surfaces by catalytically cracking said feed in a catalytic cracking zone operating at catalytic cracking conditions by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, and separating cracked products from spent catalyst in said catalyst disengaging zone to produce a cracked product vapor phase including coke precursors which is removed from said disengaging zone via a transfer line as a vapor product and a spent catalyst phase which is discharged from said disengaging zone into a catalyst stripper, stripped, regenerated by contact with a regeneration gas and recycled to said cracking reactor to crack said heavy feed, characterized by adding to said cracked vapor an amount of a coke suppressing additive sufficient to suppress deposition of coke on solid surfaces, and wherein said additive is added in a form and amount such that at least 90% of said additive will remain with cracked vapor product and less than 10% of said additive will deposit on said catalyst.

In a more limited embodiment, the present invention provides a method of controlling the rate of deposition of coke on vessel walls and transfer lines downstream of catalytic cracking reactors wherein a heavy hydrocarbon feed comprising hydrocarbons having a boiling point above about 650° F. is catalytically cracked to produce spent catalyst and cracked products comprising coke precursors which form coke deposits on solid surfaces by catalytically cracking said feed in a catalytic cracking zone operating at catalytic cracking conditions by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, and separating cracked products from spent catalyst in said catalyst disengaging zone to produce a cracked product vapor phase including coke precursors which is removed from said disengaging zone via a transfer line as a vapor product and a spent catalyst phase which is discharged from said disengaging zone into a catalyst stripper, stripped, regenerated by contact with a regeneration gas to produce hot regenerated catalyst having a regenerated catalyst temperature which is recycled to said cracking reactor to crack said heavy feed, characterized by controlling the rate of addition of a coke suppressing additive to said cracking reactor means based on a direct or indirect measurement of coke formation or deposition downstream of said cracking reactor.

DETAILED DESCRIPTION

Figure 1:
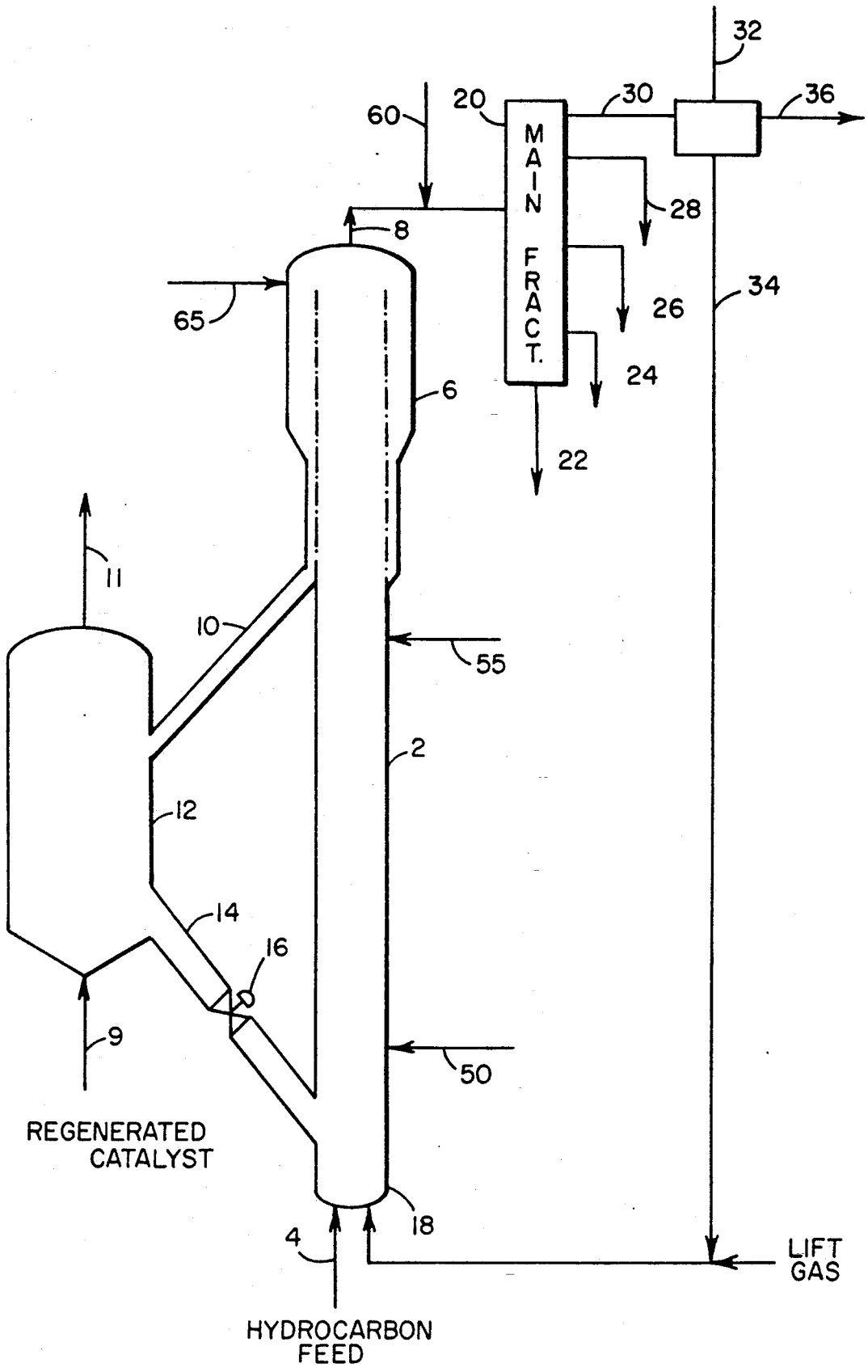
FIG. 1 is a schematic diagram of a conventional FCC reactor and regenerator, with a coke inhibitor additive line to the riser reactor and to the transfer line.

FIG. 1 is a schematic flow diagram of a conventional FCC unit, with several additive lines of the invention, and including a control method of adding additive of the invention.

Feed is charged to the bottom of the riser reactor 2 via inlet 4. Hot regenerated catalyst is added via conduit 14, equipped with a flow control valve 16. A lift gas is introduced near the liquid and solid feed inlets via conduit 18. The riser reactor is an elongated, cylindrical smooth-walled tube.

The feed vaporizes and forms a dilute phase suspension with the FCC catalyst. The suspension passes up the riser, which generally gets wider to accommodate volumetric expansion. Cracked products and coked catalyst may pass into a solid-vapor separation means, such as a conventional cyclone. Preferably, the riser has a deflector and a short residence time stripper, as disclosed in U.S. Pat. No. 4,629,552 (Haddad and Owen) incorporated by reference. Another good design is the closed cyclone design disclosed in U.S. Pat. No. 4,749,471 (Kam et al) which is incorporated by reference. A means for stripping entrained hydrocarbons from the catalyst is usually provided in the base of vessel 6. Neither this stripping section, nor the solid-gas separation equipment is shown in the drawing for clarity. Such equipment is conventional. Cracked products are withdrawn from the reactor by conduit 8.

Stripped catalyst containing coke is withdrawn via conduit 10 and charged to regenerator 12. The catalyst is regenerated by contact with an oxygen-containing gas, usually air added via line 9. Flue gas is withdrawn from the regenerator by line 11.

Usually the feed temperature is about 150° C. to 375° C. The regenerator operates at about 650° C. to 750° C. and the catalyst to feed weight ratio is usually about 3:1 to 10:1, adjusted as necessary to hold a reactor outlet of about 450° C. to 550° C.

Cracked product from the FCC unit passes via line 8 to main fractionator 20, where product is separated into a heavy slurry oil stream 22, heavy distillate 24, light distillate 26, naphtha 28, and a light overhead stream 30, rich in C2–C4 olefins, C1–C4 saturates, and other light cracked gas components. This light stream is usually treated in gas concentration plant 32 to separate the light hydrocarbons into various product fractions, and to remove acid gasses such as H2S. Preferably a light, $H_2$ rich gas stream is recycled from the gas concentration plant via line 34 for use as all, or part, of a lift gas used to contact catalyst in the base of riser 2.

Coke suppressing additive can be added to one or more of the locations shown in FIG. 1, to the base of the riser 2 via additive inlet line 50, to an upper portion of the riser via inlet line 55, to the dome of the reactor vessel via inlet line 65, or to the reactor transfer line 8 via line 60.

Figure 2:
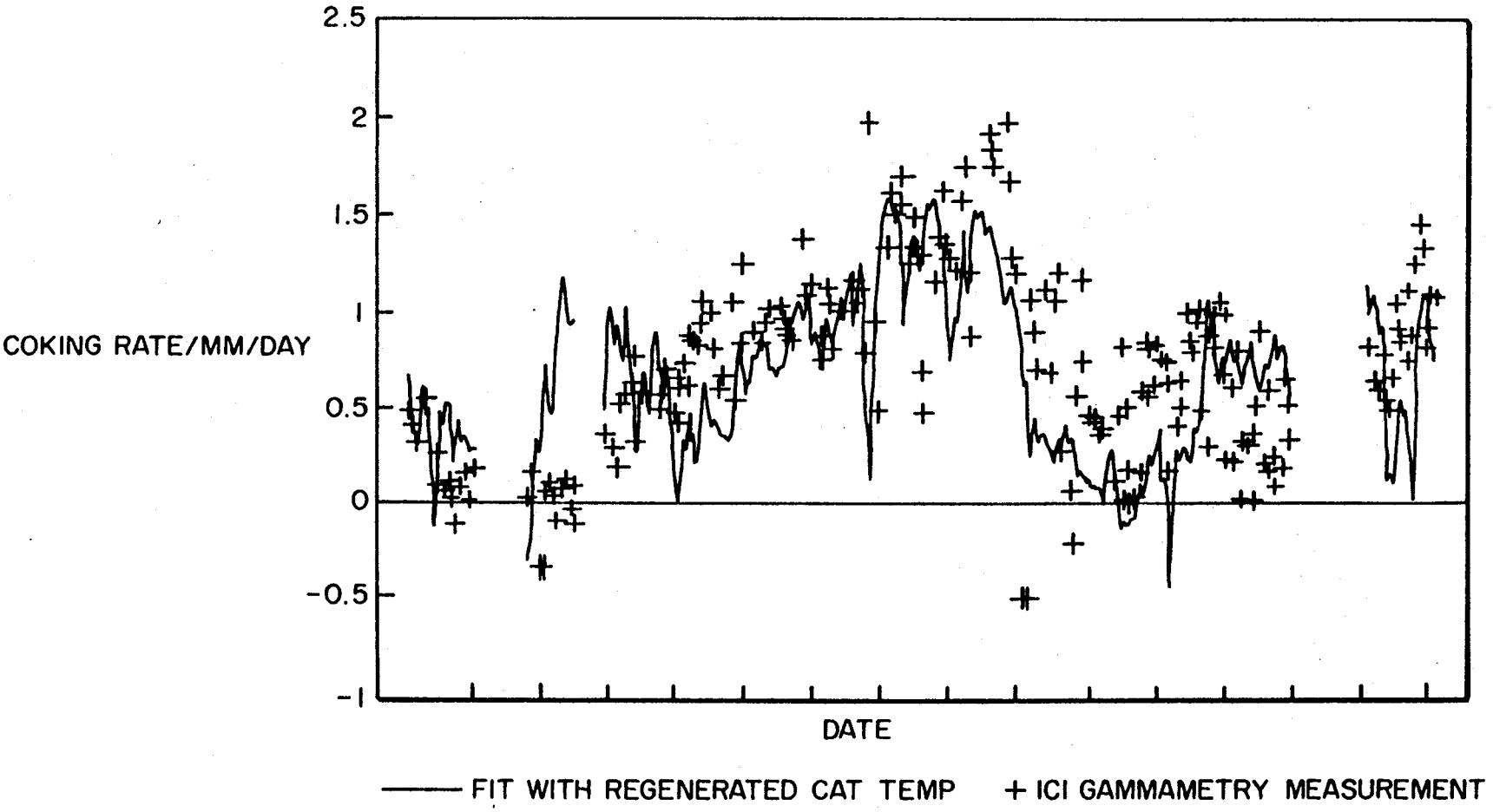
FIG. 2 is a plot, from a commercial FCC unit, showing coke deposition rates in the transfer line to the FCC main column.

FIG. 2 shows a plot of coke growth in a transfer line, plotted against days on stream. The coking rate, "+" is shown in mm/day (as determined by frequent gamma radiation measurements) versus days on stream. The plot also includes a fit with relative regenerated catalyst temperature, the solid line. The Figure shows quite a strong correlation between coking rate and regenerated catalyst temperature. When the temperature of regenerated catalyst was high, the coking rate was high. When regenerated catalyst temperatures were low the coking rate reduced, and perhaps even eliminated. This made us realize that coke was not a constant problem, and although probably exacerbated by higher reactor temperatures correlated fairly strongly with regenerated catalyst temperature. When the temperature of regenerated catalyst was low, e.g, because a low coking feed, or low coke forming catalyst was used, or some other set of conditions existed which reduced the temperature of catalyst in the regenerator, we did not need much additive. When regenerator temperatures increased, the coking rate increased significantly. This realization provided the key to a much more efficient way to add our coke suppressing additive, one embodiment of which is shown in FIG. 3.

Figure 3:
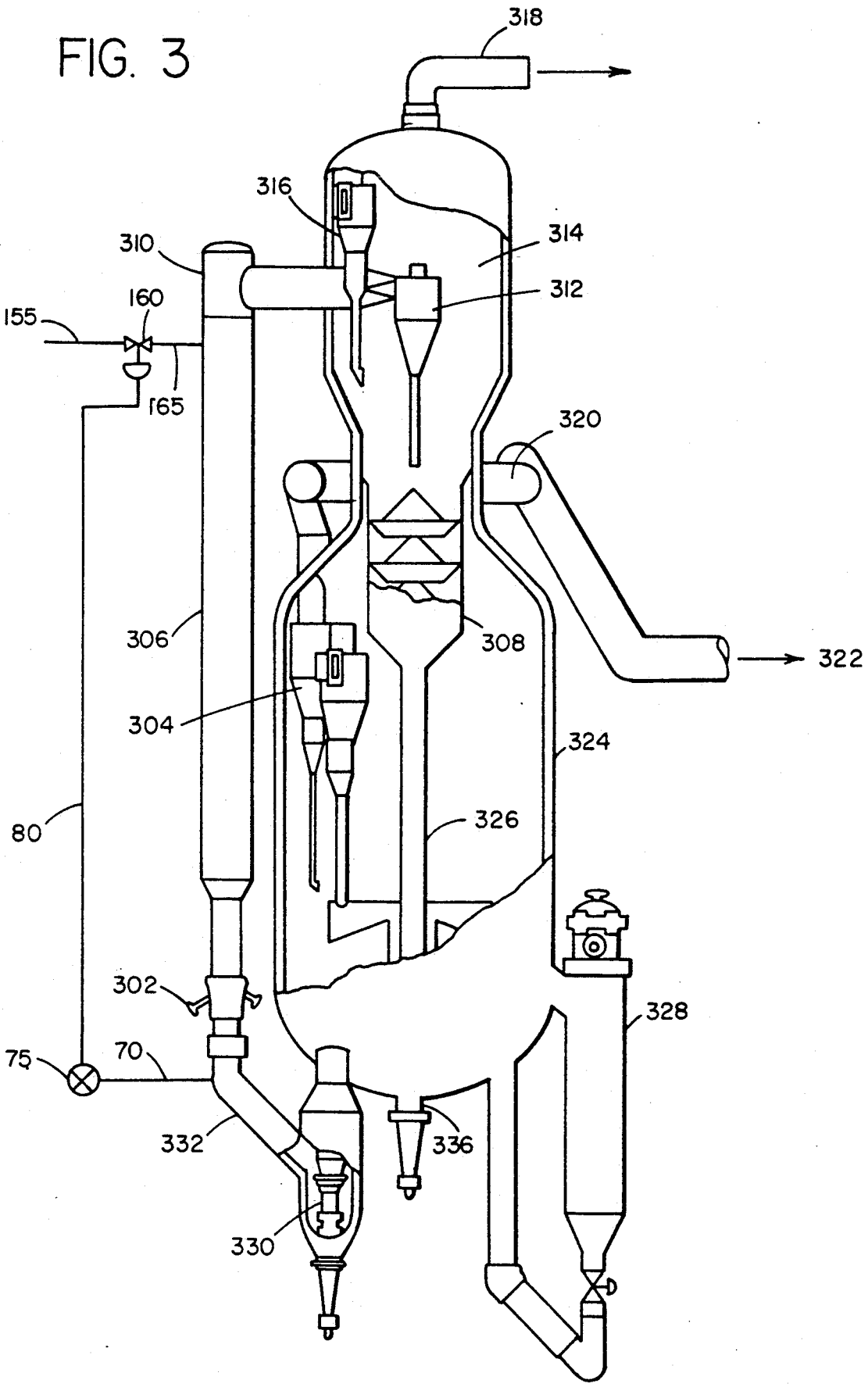
FIG. 3 shows a preferred method of controlling the rate of additive addition to a "stacked" reactor/regenerator.

FIG. 3 is a simplified schematic view of an FCC unit of the prior art, similar to the Kellogg Ultra Orthoflow converter Model F shown as FIG. 17 of Fluid Catalytic Cracking Report, Avidan et al, in the Jan. 8, 1990 edition of Oil & Gas Journal, with a preferred method of controlling the rate of additive addition to the FCC riser reactor.

A heavy feed such as a gas oil, vacuum gas oil is added to riser reactor 306 via feed injection nozzles 302. The cracking reaction is completed in the riser reactor, which takes a 90° turn at the top of the reactor at elbow 310. Spent catalyst and cracked products discharged from the riser reactor pass through riser cyclones 312 which efficiently separate most of the spent catalyst from cracked product. Cracked product is discharged into disengager 314, and eventually is removed via upper cyclones 316 and conduit 318 to the fractionator.

Spent catalyst is discharged down from a dipleg of riser cyclones 312 into catalyst stripper 308, where one, or preferably 2 or more, stages of steam stripping occur, with stripping steam admitted by means not shown in the figure. The stripped hydrocarbons, and stripping steam, pass into disengager 314 and are removed with cracked products after passage through upper cyclones 316.

Stripped catalyst is discharged down via spent catalyst standpipe 326 into catalyst regenerator 324. The flow of catalyst is controlled with spent catalyst plug valve 336.

Catalyst is regenerated in regenerator 324 by contact with air, added via air lines and an air grid distributor not shown. A catalyst cooler 328 is provided so that heat may be removed from the regenerator, if desired. Regenerated catalyst is withdrawn from the regenerator via regenerated catalyst plug valve assembly 330 and discharged via lateral 332 into the base of the riser reactor 306 to contact and crack fresh feed injected via injectors 302, as previously discussed. Flue gas, and some entrained catalyst, are discharged into a dilute phase region in the upper portion of regenerator 324. Entrained catalyst is separated from flue gas in multiple stages of cyclones 304, and discharged via outlets 308 into plenum 320 for discharge to the flare via line 322.

What is described above in regard to FIG. 3 is conventional. Adding coke suppressing additive to the riser reactor via line 155 and control valve 160 and nozzle 165 is new. Controlling the flow rate of additive based on the temperature of regenerated catalyst is also new. Thermocouple 70 in the regenerated catalyst line 332 sends a signal proportional to catalyst temperature to temperature controller 75, which in turn sends a signal via signal transmission means 80 to flow control valve 160. This allows regenerated catalyst temperature to control the rate of additive addition. Although additive spray nozzle 165 discharges a dispersion of additive into the top portion of the riser reactor, it is also possible to use the same control method to control additive flow into the dome area 314, or into the transfer line 318.

It is also possible, although not shown, to control additive flow by direct measurement of the coking rate at some point in the cracking unit. Coking rate can be determined based on ultrasound measurements, visual observation in a transparent portion of a transfer line or vessel, or using a radiation based technique. ICI gammametry measurement is preferred. All of these "direct" methods are somewhat imprecise, and give some scatter, as coke is an amorphous thing to measure. Thus although direct measurement of coking rate can be used to control the rate of coke suppressing additive, it is not preferred, because the direct method is not very sensitive to changes in coke rate. Also, once coke is formed it is difficult, if not impossible to remove, so a control method which does not rely on coke deposition is preferably used as the primary means of control of the flow rate of coke suppressing additive.

ADDITIVE ADDITION POINTS

The process and control method of the present invention requires addition of a coking suppressing additive, such as a free radical inhibitor, upstream of, or at the point of, coke formation The limits of good additive addition points will be briefly reviewed.

The additive should be added in a form, and in a way, that it will accomplish its goal of quenching or reducing coke formation wherever coke formation is a problem. There are three places in catalytic cracking units where coke formation downstream of catalyst/cracked vapor separation is a problem, and the present invention can be used to eliminate or minimize coking in any or all of these three areas. The three areas of coke formation, in reverse order of importance, are:

1. the base of the main column
2. the dome of the cracking reactor vessel
3. the transfer line to the main column.

Coking in the main column can be a problem, particularly in older units, such as moving bed crackers with bubble cap columns. Our additive can solve this problem. We would inject additive upstream of, or even in the base of, the main column. Rather than inject "dome steam" into the base of the TCC main column, we would inject a dispersion of anti-coking additive into the main column, not to purge dead spaces (as is the conventional use of dome steam) but to assure that the stagnant regions of the main column are contacted with coke suppressing additive. It will usually be more effective, from a mixing standpoint, to add the coke suppressing additive to the inlet to the column. In this way, the capital and operating expense of recycle a heavy, vaporizable liquid such as a cycle oil to the main column inlet can be replaced with a much smaller additive addition system. The present invention may also be used to reduce, rather than eliminate, quenching upstream of the main column, by recycling a smaller amount of quench liquid, but which contains additives dissolved or dispersed in it.

There are very few cracking units with bubble cap trays, i.e., with a coking problem in the main column. Far more pervasive are problems of coke formation in the transfer line, or in the dome of the vessel containing the reactor outlet.

The present invention can help reduce dome coke formation, and will permit reduction or elimination of dome steam addition. This will usually be an incidental benefit, associated with solving the problem of transfer line coking. It usually will not be cost effective to practice additive addition merely for solving a "dome coke" problem, because the prevailing solution, adding modest amounts of steam, works well. The reduction in sour water production, and unloading of the main column by reduction in dome steam rate may be of great importance in some locations. Additive must be added to the dome, or to some point upstream of the dome.

To reduce transfer line coking, the additive must also be mixed with the hot reactor vapor upstream of the point where coke will form. In most units, this will require an addition point just upstream of the transfer line, preferably to a point downstream of the point where spent catalyst and cracked products are separated. In this way the additive will have plenty of time to mix with cracked vapor, but will not be adsorbed, or react with, the much larger amounts of spent catalyst, i.e., only one ton of cracked vapor needs to be treated, as opposed to one ton of cracked vapor and 5 tons of spent catalyst, if additive addition occurs upstream of e.g., a riser cyclone outlet.

The additive may also be mixed with the feed, or added at the point where feed and catalyst mix, but preferably the additive is added somewhat downstream of this point. Much of the additive may be cracked or its effectiveness degraded if it is subjected to the same cracking conditions used to convert heavy oil into lighter products. For this reason, the additive will usually be most effective, i.e., will survive the cracking reaction zone better, when added after cracking of fresh feed is at least 10% complete, and most preferably after at least 25% conversion of fresh feed has occurred. For maximum effectiveness in regard to mixing of additive with cracked product vapor containing coke precursors, it will usually be preferred to add the additive after a majority of the fresh feed conversion has taken place, but upstream of the point of separation of a majority of the spent cracking catalyst from the cracked product. There will be some loss of additive to spent catalyst, but thorough mixing of additive with cracked products by adding the additive upstream of, e.g., a riser cyclone.

ADDITIVE COMPOSITION

Any additive can be used which will, under FCC transfer line conditions tend to inhibit or suppress coke formation on solid surfaces. Relatively simple laboratory test procedures, discussed hereafter, can be used to determine an additives effectives, and optimize the concentration of the additive.

We believe that the additives function as free radical inhibitors, which quench free radical reactions that convert heavy hydrocarbons into coke. We may also be completely wrong in our understanding of the reaction mechanism by which coke formation is inhibited, i.e., the preferred compounds include several classes of materials, which may work in different ways.

It is not even essential that the additive prevent or retard the formation of coke, as it is sufficient if the additive allows lots of coke to form but keeps it in some way from depositing on the transfer line. An acceptable additive would be one which allowed coke to form, but formed coke particles of such small size that coke was swept along with the cracked vapors rather than deposited on transfer lines. Coking in FCC transfer lines may also be an electrostatic phenomenon, such that suppression of static charges will reduce coke deposition rates, if not coke formation rates. The amount of coke that deposits on a transfer line, or elsewhere in a cat cracker, is usually such a minuscule amount of the feed that it is not observable in a material balance, but nonetheless can be sufficient to shut a unit down. Although we believe that free radical formation causes the coke to form, and free radical inhibitors suppress its formation, there are probably other additives that can be used to suppress coke formation on solid surfaces, and the control method of the present invention will work well with these other additives.

Several different types of additive are discussed below, along with patents providing more details about the materials.

U.S. Pat. No. 4,680,421 teaches use of ammonium borate, specifically ammonium biborate and ammonium pentaborate, preferably dissolved in glycol.

U.S. Pat. No. 4,756,820 teaches use of boron oxides, borates, borate ester, peroxyborates, borane, organorboranes, and salts of boron. U.S. Pat. No. 3,328,284 teaches coke retardancy using oxyalkylated phenolic compounds and organic sulfonate salts including the Group IIA organic sulfonate salts. These materials are especially useful at temperature of 200–800° F.

U.S. Pat. No. 4,840,720 teaches minimizing fouling of process equipment using a coke retarder of elemental phosphorous and compounds thereof to retard coke formation during high temperature petroleum treatments.

U.S. Pat. No. 4,024,048 teaches use of phosphate and phosphite mono and diesters and thioesters as antifoulants.

U.S. Pat. No. 4,756,819 teaches thermal treatment of asphaltene containing feeds in the present of an additive to prevent coke formation. The additive is a salt of a metal of V, Mo, Cr, W, Fe, Co and Ni at a concentration of 100 to 2500 ppm metal relative to feed.

The above U.S. patents relating to coke retardants are incorporated herein by reference.

Although U.S. Pat. No. 4,756,819, discussed above, shows that Ni and V salts can prevent coke formation, such salts are not apparently formed during catalytic cracking. The worst feeds, from an asphaltene or CCR or coking tendency aspect, will usually contain relatively large amounts of Ni and V. Most FCC feeds contain some tramp iron, much of it rust or corrosion from tankers. Refiners consider Ni and V, and other metals to a lesser extent, poisons in catalytic cracking, and go to some lengths to passivate Ni and V. So far as is known, any refiner with large amounts of Ni and V in the feed, or on the catalyst, has generally experienced more, not fewer, coking problems, primarily due to the hydrogenation/dehydrogenation reactions promoted by Ni and V and similar metals.

Thus many of the additives which can be safely used in thermal process are not at all suitable for use in catalytic cracking, at least not suitable if more than a minimal amount of the additive would end up on the cracking catalyst. An extreme example of a coke suppression method not suitable for use in a cat cracker is disclosed in French Pat. No. 2,202,930, which teaches adding to a tubular furnace (which cracks hydrocarbons) molten lead containing a mixture of oxides or salts of various metals, e.g., molten lead containing K3VO4, SiO2 and NiO.

Suitable additives must be added in an amount, and in a form, and location in the cat cracker, that they will efficiently retard coke formation, and not have any significant adverse affect on the cat cracker. If the additive is added downstream of catalyst/cracked product separation, or somewhat upstream of this point, in a form and manner where the additive does not deposit on the catalyst, the refiner has great latitude in selecting a coke retarder. If the additive is added so that some or most of it ends up on the cracking catalyst, it is important that the additive not damage the cracking catalyst.

The preferred materials are believed to be free radical suppressing additives, typically oxygenates. Suitable materials include antioxidants, such as alkylated-diarylamines, phenolics, diaryl phosphites and triarylphosphates or ionic and non-ionic detergents such as calcium benzene sulfonate and alkylated benzenesulfonates, polyalkyl ethers and the like and mixtures thereof.

In general, 0.1 to 1,000 ppm of additive, exclusive of diluents, solvents or dispersants which may be present, can be used with good result. Preferably 0.5–100 wt ppm of additive is used, and most preferably 1–50 wt ppm of additive, with 1 to 10 wt ppm additive giving especially good results.

This is based on additive addition at the mid-point of the riser, or downstream of this point. Addition nearer the point of catalyst addition is also possible, but more additive will frequently be required, from 1.5 to 10 times as much additive may be needed to overcome additive loss due to cracking in the riser reactor.

SCREENING PROCEDURE

The type and amount of coke suppressing additive can be determined based on simple lab experiments. Although any existing test method which indicated the coking tendency of hydrocarbons can be used as a screening test, e.g., the JFTOT or Jet Fuels Thermal Oxidation Test, it is preferred to used a modified test procedure. The preferred apparatus is the Hot Liquid Process Simulator, with a Reservoir, pump, and line temperature of 400° F., operating at a flow rate of 1.11 gallons per minute, for 4 hours, using a heater tube temperature of 800° to 1000° F., and a heater tube power output of 85 BTU/hr.

The system pressure is 150 psia. This pressure is quite a bit greater than that used in catalytic cracking units, but attempts to use lower pressures, 30 and 80 psia, led to flashing of lighter materials, causing pieces of coke to flake off. This cause irreproducible results, and plugged lines which led to premature shutdowns. For this reason, we preferred to operate at 150 psia.

FEEDS

Most FCC and TCC units crack gas oil or vacuum gas oil feeds, i.e., those having an initial boiling point above 400–500° F., and an end boiling point above 750–850° F.

The feed can include any wholly or partly non-distillable fraction, e.g. 1000° F.+ boiling range material. Resids, deasphalted resids, tar sands, shale oils, coal liquids and similar heavy material, may be used as part or all of the feed.

The process and control method of the present invention will be most beneficial when this technology is used to permit processing of poorer quality feedstocks.

CATALYST

Conventional cracking catalysts can be used.

EXPERIMENTS

Several tests of different anti-coking additives were conducted. The test used the modified JFTOT apparatus described above. A variety of additives were tested, including several which were developed for use in cat cracking, but not as coke retardants. Thus metals passivators, free radical scavengers, and dispersants were tested. The additives, and their nominal intended used are described in the Table hereafter:

ADDITIVE FUNCTION TABLE

| Additive | Metals Passivator | Free Radical Scavenger | Dispersant |
|---|---|---|---|
| BETZ 7R19 | X | | |
| PETROLITE Petrotec 4000 | X | | ? |
| NALCO 5270 | | X | X |
| NALCO 87RC130 | | X | X |
| CHEMLINK MJM 1188 | X | X | X |

Figure 4:
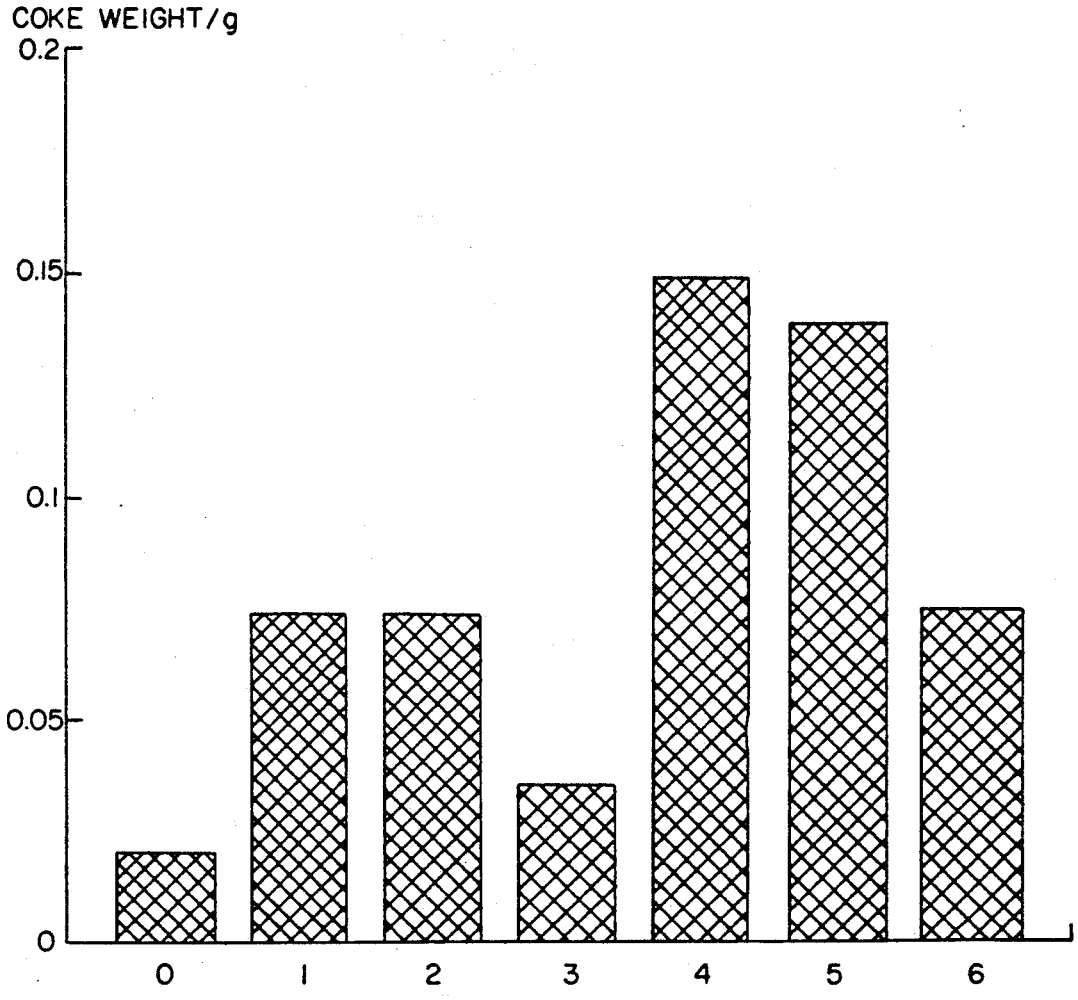
FIG. 4 shows relative coking rates with a number of different commercially available additives.

The results of the screening tests of different additives are shown in FIG. 4. The figure shows 7 columns of coke yields:

0. LETGO—a standard clean feed (LETGO, Light East Texas Gas Oil) is a universal test feed, which is fairly easy to crack and never causes a coking problem. No additive was present.

1. NIG/AH is a much heavier, harder to crack feed which is a mix of Nigerian and Arab Heavy. This feed has a high coking tendency. Test results are for pure feed, with no additive of any kind. This feed produces much more coke in the standardized test procedure used.

Tests or tables 2–6 represent the NIG/AH feed with 5 ppm of the listed additive present. In general the vendors do not list active ingredients nor concentrations, but it is believed that most of these additives are in the area of 40% active ingredients, with the remainder being solvent. The numbers reported are based on (active ingredient+solvent), i.e., if 1,000,000 pounds of feed were processed though the test apparatus 5 pounds of the additive would be poured out of the additive vat and mixed with the feed.

2. CHEMLINK MJM 1188 additive in the NIG/AH feed did not reduce coke make, as compared to the standard charge of NIG/AH.

3. NALCO 87RC130 additive did a good job of reducing coke make at the 5.0 ppm level.

4. PETROLITE PETROTEC 4000 increased coke make.

5. BETZ 7R19 increased coke make.

6. NALCO 5270 left coke make essentially unchanged.

Figure 5:
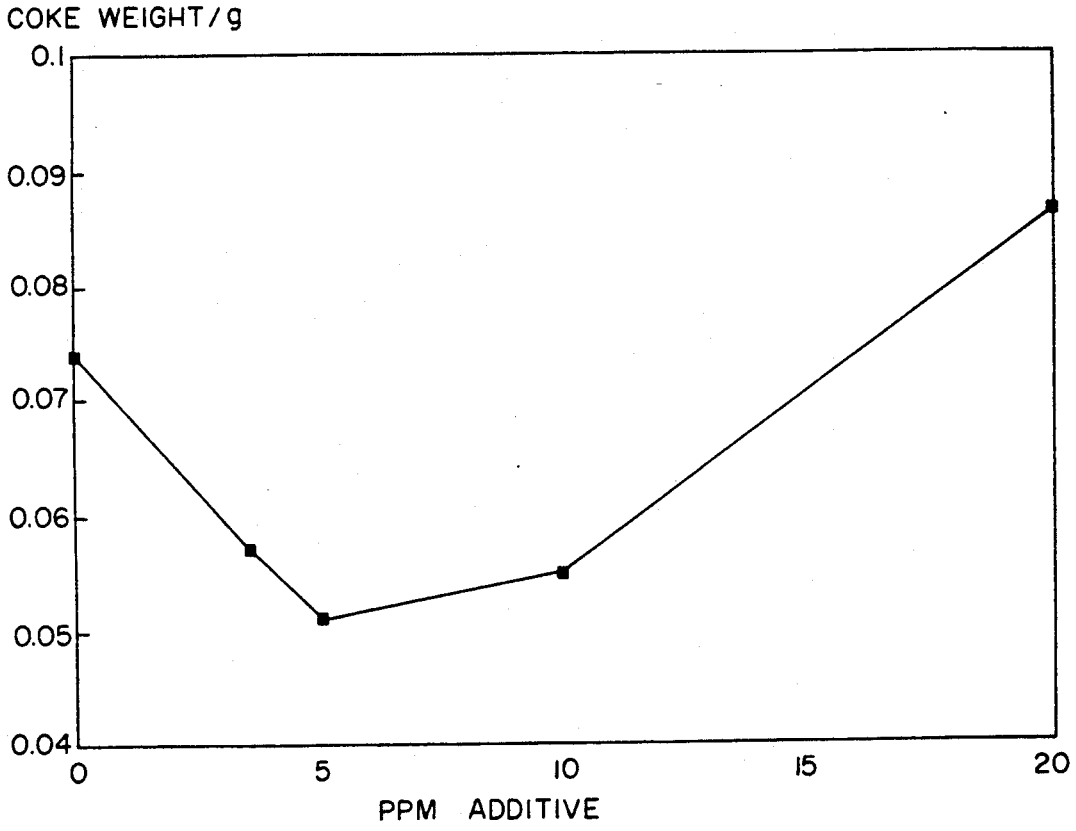
FIG. 5 shows changes in coke rate when using different amounts of a preferred additive.

FIG. 5 shows the results of additional experiments run to determine the optimum amount of NALCO 87RC130 additive. With no additive the coke make was the coke make reported in Column 1 (NIG/AH, no additive.). The coke make dropped with increasing amounts of additive, and seemed to reach a minimum around 5 ppm of additive, which probably represented around 2 wt ppm additive on active ingredient. Higher levels of additive, 10 ppm on (active ingredient+solvent) did not reduce coke make and may actually increase coke make some, while extremely large amounts of this additive, 20 wt ppm, increased coke yield.

Different feeds, and different additive, may behave differently in the feed. Screening tests can be used to get a rough idea of which additives will be useful, but this screening test should be supplemented with additional tests to determine the optimum dosage. Ideally, the final optimization is left for field tests, using ultrasound or ICI gammametry or an equivalent test method which indicates local coking. Hot wire anemometers, visual methods, weighing of the transfer line, etc., may also be used, but are not believed to be as sensitive. The reason local optimization of additive dosage, based on in situ measurements, is preferred is because it is difficult to duplicate in a pilot plant conditions which exist in an FCC transfer line. Conditions in FCC units also tend to change, with constant fluctuations in feed rates, riser top temperatures, and equilibrium catalyst properties being the norm rather than the exception. Overdosing with additive, besides wasting additive, may lead to increased coking rates, so continued monitoring, or at least addition of slightly less than optimum amounts of additive will be optimum for the unit, even if not optimum for minimizing coke deposition.

We claim:

1. A fluidized catalytic cracking process wherein a heavy hydrocarbon feed comprising hydrocarbons having a boiling point above about 650° F. is catalytically cracked to produce spent catalyst and cracked products comprising coke precursors which form coke deposits on solid surfaces comprising:

a. adding to the base of a riser reactor at a heavy hydrocarbon feed addition point said heavy feed and mixing said feed with a source of hot regenerated catalytic cracking catalyst withdrawn from a catalyst regenerator;

b. catalytically cracking said feed in said riser catalytic cracking zone, at a temperature of 425° to 600° C., a catalyst to feed weight ratio of about 3:1 to 10:1 and in the absence of added hydrogen, to produce catalytically cracked vapor products and spent catalyst;

c. adding to said riser reactor, downstream of the point of feed addition to said riser and upstream of a transfer line used to transfer catalytically cracked products to a fractionation column, a coke suppressing additive in a form and in an amount sufficient to suppress coke deposition in said transfer line, and in a form and amount which has no adverse affect on the cracking activity of the cracking catalyst;

d. discharging from the top of said riser reactor a mixture of catalytically cracked vapor products containing said additive and spent catalyst;

e. separating in a spent catalyst/vapor disengaging zone said mixture of spent catalyst and cracked vapor products to produce a cracked product vapor phase containing said additive and spent catalyst;

f. transferring from said disengaging zone said separated cracked vapor products via said transfer line to a fractionator;

g. stripping said spent catalyst from said disengaging zone in a catalyst stripping means to produce stripped catalyst;

h. regenerating said stripped catalyst by contact with a regeneration gas to produce regenerated catalyst; and i. recycling said regenerated catalyst to said base of said reactor to mix with said heavy feed.

2. The process of claim 1 wherein said additive is added just upstream of a riser catalyst outlet and disengaging zone.

3. The process of claim 1 wherein said additive is added downstream of said disengaging zone.

4. The process of claim 1 wherein said additive, exclusive of diluents, solvents or dispersants which may be present, is present in an amount equal to 0.1 to 1,000 wt ppm based on weight of cracked vapor product.

5. The process of claim 1 wherein said additive, exclusive of diluents, solvents or dispersants which may be present, is present in an amount equal to 0.5 to 100 wt ppm based on weight of cracked vapor product.

6. The process of claim 1 wherein said additive, exclusive of diluents, solvents or dispersants which may be present, is present in an amount equal to 1 to 10 wt ppm based on weight of cracked vapor product.

7. A fluidized catalytic cracking process wherein a heavy hydrocarbon feed comprising hydrocarbons having a boiling point above about 650° F. is catalytically cracked to produce spent catalyst and cracked products comprising coke precursors which form coke deposits on solid surfaces comprising:

a. adding to the base of a riser reactor at a heavy hydrocarbon feed addition point said heavy feed and mixing said feed with a source of hot regenerated catalytic cracking catalyst having cracking activity withdrawn from a catalyst regenerator;

b. catalytically cracking said feed in said riser catalytic cracking zone, at a temperature of 425° to 600° C., a catalyst to feed weight ratio of about 3:1 to 10:1 and in the absence of added hydrogen, to produce catalytically cracked vapor products and spent catalyst;

c. adding to said riser reactor, downstream of the point of feed addition to said riser and upstream of a transfer line used to transfer catalytically cracked products to a fractionation column, a coke suppressing additive in a form and in an amount sufficient to suppress coke deposition in said transfer line, and in a form and amount such that at least 90% of said additive remains with cracked vapor product and less than 10% of said additive deposits on said cracking catalyst;

d. discharging from the top of said riser reactor a mixture of catalytically cracked vapor products containing said additive and spent catalyst;

e. separating in a spent catalyst/vapor disengaging zone said mixture of spent catalyst and cracked vapor products to produce a cracked product vapor phase containing said additive and spent catalyst;

f. transferring from said disengaging zone said separated cracked vapor products via said transfer line to a fractionator;

g. stripping said spent catalyst from said disengaging zone in a catalyst stripping means to produce stripped catalyst;

h. regenerating said stripped catalyst by contact with a regeneration gas to produce regenerated catalyst; and i. recycling said regenerated catalyst to said base of said reactor to mix with said heavy feed.

8. The process of claim 7 wherein said additive, exclusive of diluents, solvents or dispersants which may be present, is present in an amount equal to 0.1 to 1000 wt ppm based on weight of cracked vapor product.

9. The process of claim 7 wherein said additive, exclusive of diluents, solvents or dispersants which may be present, is present in an amount equal to 0.5 to 100 wt ppm based on weight of cracked vapor product.

10. The process of claim 7 wherein said additive, exclusive of diluents, solvents or dispersants which may be present, is present in an amount equal to 1 to 10 wt ppm based on weight of cracked vapor product.

11. The process of claim 7 wherein the additive is a free radical scavenger.

12. The process of claim 7 wherein the additive is selected from the group of ammonium borate, ammonium biborate and ammonium pentaborate, boron oxides, borates, borate ester, peroxyborates, borane, organoboranes, and elemental phosphorous and compounds thereof, phosphate and phosphite mono and diesters and thioesters, and a salt of a metal of V, Mo, Cr, W, Fe, Co and Ni.

13. A fluidized catalytic cracking process wherein a heavy hydrocarbon feed comprising hydrocarbons having a boiling point above about 650° F. is catalytically cracked to cracked products including coke precursors which form coke deposits on solid surfaces comprising:

a. adding to the base of a riser reactor a heavy hydrocarbon feed and mixing said feed with a source of hot regenerated catalytic cracking catalyst having cracking activity withdrawn from a catalyst regenerator;

b. catalytically cracking said feed in said riser catalytic cracking zone, at a temperature of 425° to 600° C., a catalyst to feed weight ratio of about 3:1 to 10:1 and in the absence of added hydrogen, to produce catalytically cracked vapor products containing coke precursors and spent catalyst;

c. discharging from the top of said riser reactor a mixture of catalytically cracked vapor products containing coke precursors and spent catalyst;

d. separating in a spent catalyst/vapor disengaging zone said mixture of spent catalyst and cracked vapor products to produce a cracked product vapor phase containing said coke precursors and spent catalyst;

e. adding to said separated cracked product vapor phase a coke suppressing additive;

f. transferring from said disengaging zone said separated cracked vapor products via said transfer line to a fractionator;

g. coking said transfer line with said coke precursors, measuring coke formation in said transfer line, and controlling the addition of said coke suppressing additive to said separated cracked product vapor phase based on said measurement of coke formation in said transfer line;

h. stripping said spent catalyst from said disengaging zone in a catalyst stripping means to produce stripped catalyst;

i. regenerating said stripped catalyst by contact with a regeneration gas to produce regenerated catalyst; and j. recycling said regenerated catalyst to said base of said reactor to mix with said heavy feed.

14. The control method of claim 13 wherein additive addition rate is controlled based on the temperature of said regenerated catalyst.

15. The control method of claim 13 wherein the additive addition rate is determined by a direct or indirect measurement of a coke buildup in the transfer line.

* * * * *